United States Patent [19]

Chesnut et al.

[11] 4,033,522

[45] July 5, 1977

[54] MACHINE FOR ADVANCING STRIP MATERIAL THROUGH A UTILIZATION APPARATUS

[75] Inventors: W. Richard Chesnut, West Caldwell; Daniel Calligaro, Little Falls, both of N.J.

[73] Assignee: W. R. Chesnut Engineering, Inc., Fairfield, N.J.

[22] Filed: Feb. 13, 1976

[21] Appl. No.: 657,841

[52] U.S. Cl. ..... 242/75.4; 242/75.41

[51] Int. Cl.[2] ..... B65H 23/06

[58] Field of Search ..... 242/75.4, 75.41, 75.92, 242/75.43, 75.44, 75.2, 75; 254/172, 173

[56] References Cited

UNITED STATES PATENTS

| | | | |
|---|---|---|---|
| 3,083,602 | 4/1963 | Obenshain | 242/75.43 X |
| 3,257,086 | 6/1966 | Drenning | 242/75.4 |
| 3,372,886 | 3/1968 | McDonald | 242/75.42 |

*Primary Examiner*—Edward J. McCarthy
*Attorney, Agent, or Firm*—Carella, Bain, Gilfillan & Rhodes

[57] ABSTRACT

A machine for advancing strip material from a reel of the strip material through a utilization apparatus, such as a set of dies, including a reel carrier for carrying the reel of strip material and for applying a controlled drag and restoring torque to the reel of strip material, metering roll means for receiving the strip material intermediate the reel of strip material and the utilization apparatus and for advancing the strip material, spent strip material receiving means for receiving the spent strip material exiting the utilization apparatus and for maintaining within predetermined limits tension of the spent strip material exiting the utilization apparatus, electric motor means having a shaft which is mechanically coupled to the metering roll means and such motor for causing rotation of the metering roll means, and electronic control means connected to the motor means and for electrically energizing the motor means to cause rotation of the motor shaft through a predetermined program sequence whereby the strip material is advanced from the reel of strip material through the utilization apparatus in response to energization of the electric motor means.

19 Claims, 8 Drawing Figures

MACHINE FOR ADVANCING STRIP MATERIAL THROUGH A UTILIZATION APPARATUS

CROSS-REFERENCES TO RELATED APPLICATIONS

To Applicant's knowledge, there are no pending applications which relate to the present application.

BACKGROUND OF THE INVENTION

1. Field of the Invention

This invention relates to the printing arts generally, and more particularly to hot-foil stamping presses such as are used for the process of foil stamping in the packaging industry.

2. Description of the Prior Art

The prior art includes purely mechanical arrangements in which strip material is advanced through, for example, a hot-foil stamping press, by means of the operation of cam-operated reciprocating levers which transmit their pulling force via chains and sprockets to individual shafts on which the rolls of strip material are mounted. Electromechanical clutches, between the chain-driven sprockets and the shafts on which the rolls of strip material are mounted, are alternately engaged and disengaged to intermittently advance the strip material.

Disadvantages of the prior art approach include the difficulty of setting up the press caused by the necessity to precisely locate the point of attachment of each chain to the reciprocating lever. Also, it is not possible to change the program sequence, that is, the sequence of short and long advances of the strip material, while the machine is in operation, and there is an upper limit, established by the range of motion of the reciprocating lever, on the length of strip material that can be advanced during each machine cycle. Furthermore, where the mechanism for advancing the strip material is integral with the hot-foil stamping press itself, it is not possible to utilize the press for other potential uses such as stripping or punching out scrap from die cut holes.

Unknown to the prior art is the provision of a digital stepping motor to drive a metering roll, with electric power supplied to the stepping motor by an electronic control means which has the capability of causing the shaft of the stepping motor to rotate through a predetermined, but readily alterable, program sequence.

SUMMARY OF THE INVENTION

A machine for providing a strip material from a reel of the strip material to a utilization apparatus, according to the present invention, includes support means for securing component parts of the machine in a predetermined spatial relationship. A reel carrier means, secured to the support means, is provided for carrying the reel of strip material and for applying a controlled drag and restoring torque to the reel of strip material. The strip material is in frictional engagement with a motor-driven metering roll means which serves to advance the strip material. The motor-driven metering roll means is rotatably secured to the support means so as to receive the strip material intermediate the reel of strip material and the utilization apparatus.

A spent strip material receiving means, also secured to the support means, is provided to receive the spent strip material after it exits the utilization apparatus. The spent strip material receiving means also serves to maintain, within predetermined limits, tension of the strip material exiting the utilization apparatus.

Electric motor means, secured to the support means and having a shaft which is mechanically coupled to the metering roll means, for example by a timing belt and pulleys, serves to rotate the metering roll means.

Electronic control means are provided, electrically connected to the motor means, for energizing the motor means so as to cause rotation of the motor shaft through a predetermined program sequence whereby strip material is advanced from the reel of strip material through the utilization apparatus in response to energization of the electric motor means, by the electronic control means, in accordance with the predetermined program sequence.

An object of the present invention is to provide a machine for precisely and accurately advancing strip material from a reel of the strip material through a utilization apparatus such as a hot-foil stamping press. Another object of the present invention is to provide such a machine which is easily set up and which permits changing parameters of the program sequence while the hot-foil stamping press is in operation.

A further object of the present invention is to provide such a machine that is easily disconnected and removed from the hot-foil stamping press.

A further object of the present invention is to provide such a machine which permits total independence, within maximum limits, of the parameters of the program sequence.

A further object of the present invention is to provide such a machine in which there is no upper limit on the length of advance of the strip material in any given program sequence.

BRIEF DESCRIPTION OF THE DRAWINGS

A complete understanding of the invention may be obtained from the detailed description which follows, together with the accompanying drawings, wherein.

DESCRIPTION OF THE INVENTION

An understanding of the basic principles of the present invention may be obtained from FIGS. 1–7.

Figure 1:
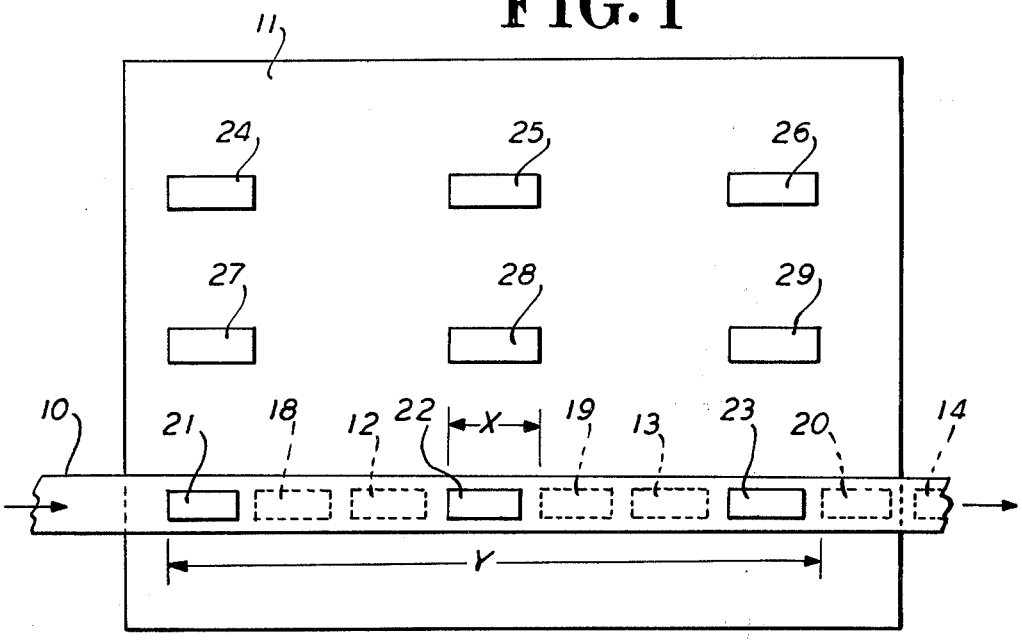
FIG. 1 is a plan view of the interior of a hot-foil stamping press, showing the manner in which the strip material is advanced.

FIG. 1 is a plan view of the interior of a hot-foil stamping press, shown schematically to illustrate the efficient utilization of the strip material 10.

Shown in FIG. 1 are dies 24–29, which serve to transfer an image from the strip material 10 onto, for example, packaging material such as cardboard. Strip material 10 is shown passing before an additional set of dies (which, for reasons of clarity, are not shown in FIG. 1). It should be understood that additional strips of material, one passing over dies 24, 25, and 26, and another passing over dies 27, 28, and 29, have also been omitted, for purposes of clarity, from FIG. 1.

For most efficient use of the strip material, as can be seen from FIG. 1, it is desirable to advance the strip material after each impression of the die by an amount X slightly greater than the length of the impression; then, after several such impressions, the strip material 10 is advanced by a length Y, the separation between the dies at either end of the platen 11, plus the length X.

More specifically, the sequence is as follows: after advancing the strip material 10 by a sufficient length to present an entirely unused portion to the dies, a first impression is made, resulting in impressions 12, 13, and 14, on the strip material 10. The strip material 10 is then advanced by a length X, and a second operation results in impressions 18, 19, and 20. The strip material 10 is then again advanced by an amount X, followed by another operation of the press, resulting in impressions 21, 22, and 23. The strip material is then advanced by a length Y, corresponding to the separation between the dies at either end of the platen 11 plus the length X, so as to present an entirely unused portion of the strip material 10 to the dies, and the process is then repeated.

Figure 2:
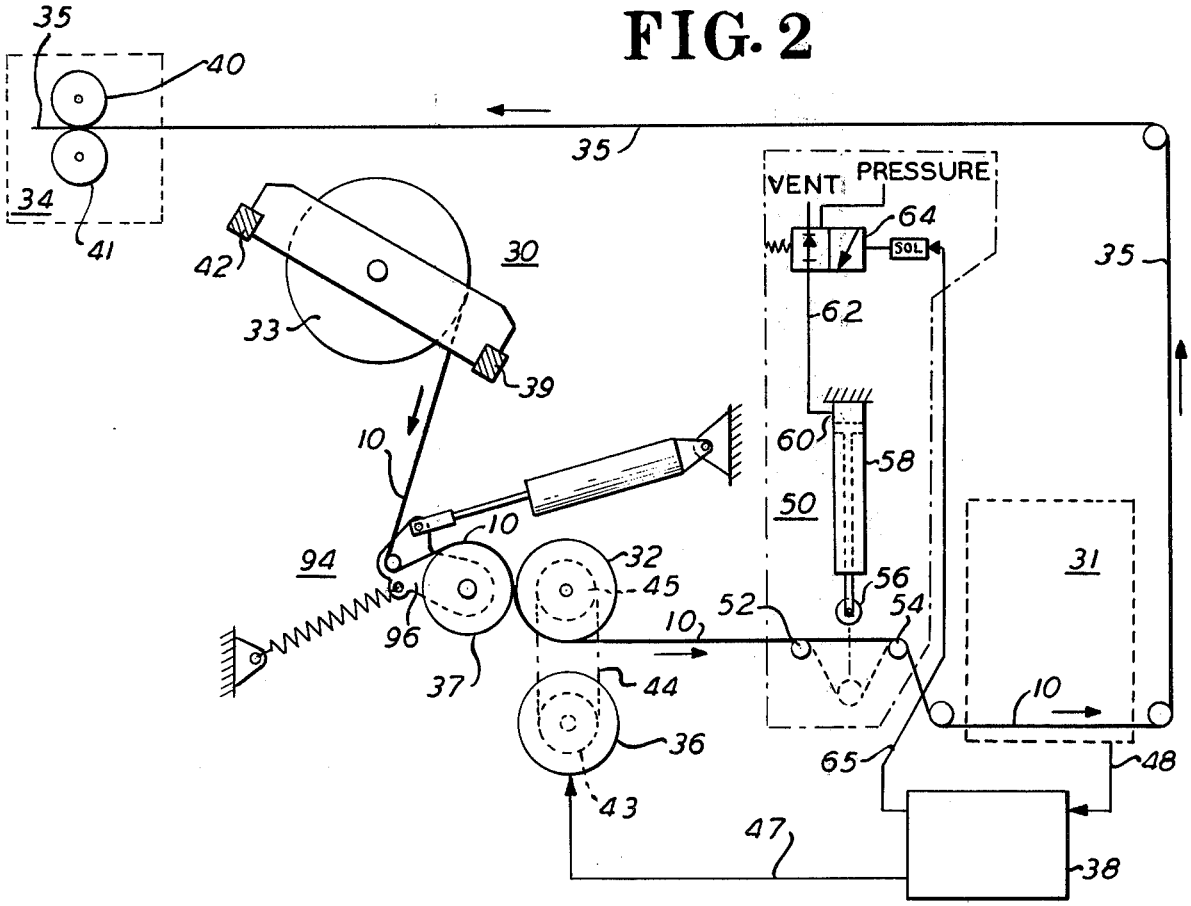
FIG. 2 is a mechanical schematic diagram of a machine for advancing strip material according to the present invention.

FIG. 2 is a mechanical schematic diagram showing the major components of a machine, according to the present invention, for advancing strip material 10 from a reel 33 of the strip material through a utilization apparatus, such as a hot-foil stamping press, the utilization apparatus denoted generally by reference numeral 31.

The machine includes, of course, a support means for securing the component parts in a predetermined spatial relationship. In order to make the operation of the machine as clear as possible in FIG. 2, the support means has not been illustrated; however, it will be understood by those skilled in the art that the support means may take the form of a frame or other structure, such as a pair of plates, parallel to each other and perpendicular to the axes of the various rolls and bars constituting the machine, and held in a rigid, fixed separation by means of other structural members connecting the plates.

In FIG. 2, reel carrier means 30 is supported by fixed tie bars 39 and 42, which are in turn secured to the support means. Reel carrier means 30 serves to carry the reel 33 of strip material. Reel carrier means 30 also serves to apply a controlled drag (i.e. a torque tending to resist the feed of strip material 10 from reel 33 of strip material) and a restoring torque, which serves to cause reel 33 of strip material to rewind, to a limited extent, to take up any slack in the strip material 10 as it leaves reel 33 of strip material.

The strip material 10 passes around metering roll 32, which is rotatably secured to the support means so as to receive the strip material intermediate the reel 33 of strip material and the utilization apparatus 31. The metering roll 32 serves to advance strip material 10 from the reel 33 of strip material through the utilization apparatus 31.

Also shown in FIG. 2 is spent strip material receiving means 34 which is also secured to the support means and which serves to receive the spent strip material 35. The spent strip material receiving means 34 also operates to maintain tension of the spent strip material 35 exiting utilization apparatus 31 within predetermined limits by, for example, frictional engagement with one or more motor-driven rolls illustrated in FIG. 2 by rolls 40 and 41.

An electric motor 36, also secured to the support means and having a shaft which is mechanically coupled to metering roll 32, serves to cause rotation of the metering roll 32 and thereby to advance strip material 10 through utilization apparatus 31. Shown schematically in FIG. 2 are drive pulley 43, secured to the shaft of electric motor 36; driven pulley 45, secured to the shaft of metering roll 32; and timing belt 44, which engages both drive pulley 43 and driven pulley 45 so as to mechanically couple electric motor 36 to metering roll 32. Of course, alternative methods such as, for example, sprockets and a chain, may also be used to couple electric motor 36 to metering roll 32.

Electronic control means 38 serves to provide electrical power to electric motor 36, and to appropriately synchronize its operation with that of the utilization apparatus 31. Electronic control means 38 is electrically connected to motor 36 by means of electrical conductors 47. Electronic control means 38 receives a timing or synchronizing signal from utilization means 31 by means of electrical conductor 48. The synchronizing signal may be generated by, for example, optically or electromagnetically sensing so as to produce a synchronization pulse from the crankshaft of utilization apparatus 31.

It can thus be seen that strip material 10 is advanced from the reel 33 of strip material through the utilization apparatus 31 in response to energization of electric motor 36 by electronic control means 38 in accordance with a predetermined program sequence established by electronic control means 38. The predetermined program sequence is, of course, synchronized with operation of the utilization apparatus 31.

An optional nip roll 37, rotatably secured to the support means so as to be in frictional engagement with metering roll 32, may be utilized for the purpose of establishing positive frictional engagement between the metering roll 32 and strip material 10. In this arrangement, nip roll 37 may be a section of steel tubing having a coating of urethane, and the strip material 10 passes between and in frictional contact with both the metering roll 32 and the nip roll 37. Nip roll 37 is not driven, but rotates by virtue of its frictional engagement with metering roll 32.

FIG. 2 also shows optional stripper means 50, which is secured to the support means, and which receives the strip material 10 intermediate the metering roll 32 and the utilization apparatus 31. The stripper means 50 serves to apply a predetermined impulse of tension to the strip material 10 within utilization apparatus 31 so as to cause release of the strip material 10 within utilization apparatus 31 after completion of each impression cycle of utilization apparatus 31.

By way of illustration, stripper means 50 may include a first fixed bar 52, which is secured to the support means; a movable bar 56, which is secured to the support means in such a way as to permit translational motion of movable bar 56 in a direction perpendicular to its own axis; and a second fixed bar 54, secured to the support means. The strip material 10, as can be seen from the illustrative arrangement of FIG. 2, passes over the two fixed bars and under the movable bar 56. Thus, when the movable bar 56 is translated as shown by dashed lines in FIG. 2, a predetermined impulse of tension is applied to the strip material 10 within utilization apparatus 31, thereby to release the strip material 10 within utilization apparatus 31.

One arrangement for causing translation of movable bar 56 is illustrated in FIG. 2, comprising air cylinder 58, which is secured to the support means, and which includes air inlet port 60. Air cylinder 58 is mechanically coupled to movable bar 56 so as to cause translation of movable bar 56 in response to actuation of air cylinder 58. Air inlet port 60 is connected, via tubing 62, to a solenoid valve 64, which is in turn connected to a source of pressure. Solenoid valve 64 is electrically connected, by means of electrical conductors 65, to electronic control means 38, which serves to electrically energize solenoid valve 64 at the appropriate time during the predetermined program sequence of operation of electric motor 36 so as to actuate air cylinder 58 to cause translation of the movable bar 56 and application of a predetermined impulse of tension to the strip material 10 within utilization apparatus 31, thereby to release strip material 10 within utilization apparatus 31, after each cycle of impression.

In a practical machine according to the present invention, the length of movable bar 56 may be such as to require that it be driven by more than a single air cylinder 58. In this situation, it is necessary to assure that the translational motion of movable bar 56 be in a direction perpendicular to its own axis; in other words, movable bar 56 must not be allowed to undergo any angular displacement as it is translated through its entire range of motion so as to insure that the predetermined impulse of tension, which is applied to strip material 10, is uniform across the length of the stripper means 50.

Figure 3:
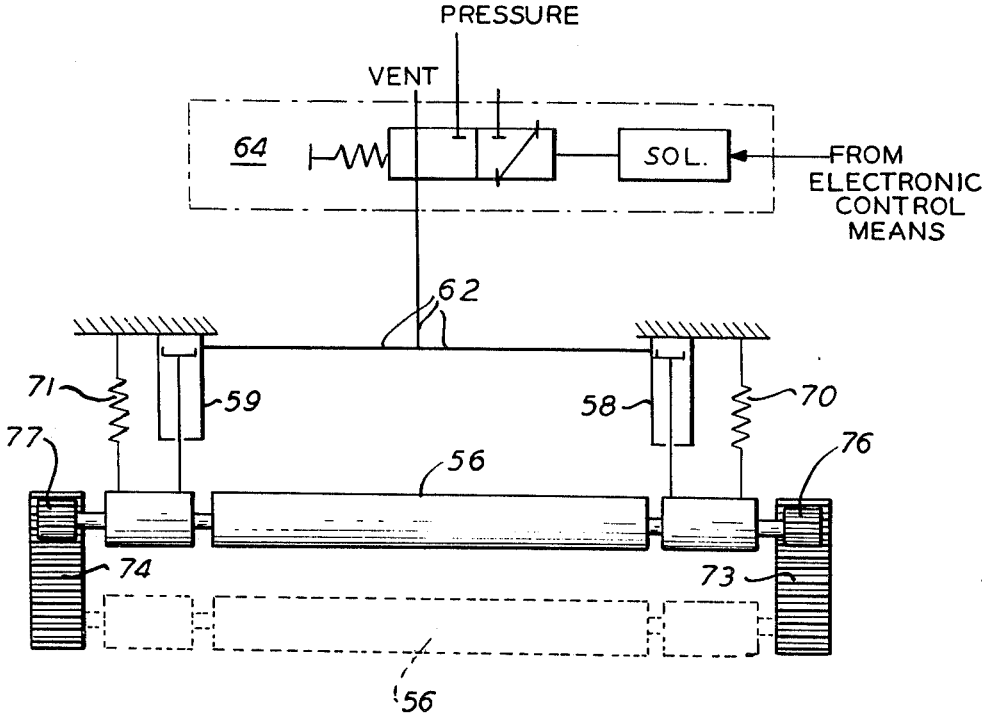
FIG. 3 is a mechanical schematic diagram showing the operation of the movable bar mechanism of the stripper means.

One arrangement for insuring a purely linear translation of movable bar 56 involves the use of rack and pinion mechanisms, and is illustrated in FIG. 3. Shown in FIG. 3 are movable bar 56, air cylinder 58, together with second air cylinder 59, tubing 62, and solenoid valve 64. Racks 73 and 74, secured to the support means, serve to engage pinions 76 and 77, which are secured to movable bar 56. Therefore, when solenoid valve 64 is energized by electronic control means 38, thereby actuating air cylinders 58 and 59, movable bar 56 is forced to rotate, by virtue of the engagement of pinions 76 and 77 with racks 73 and 74 respectively. Since pinions 76 and 77 are both secured to movable bar 56, they cannot rotate independently, but only by virtue of the rotation of movable bar 56, and thus the engagement of pinions 76 and 77 with racks 73 and 74 serves to insure that the linear motion of each extremity of movable bar 56 is identical. In this way, a purely linear translation of movable bar 56 is effected, and movable bar 56 is prevented from departing from parallelism with fixed bars 52 and 54. The position of movable bar 56 at the lower extreme of its travel is shown by dashed lines in FIG. 3.

Also shown in FIG. 3 are springs 70 and 71, which serve to return movable bar 56 to its upper position when solenoid valve 64 is de-energized, thereby releasing air cylinders 58 and 59. Of course, other mechanisms may be utilized to restore movable bar 56 to its upper position. For example, air cylinders 58 and 59 may be double-acting air cylinders, and another solenoid valve may be included to operate the return stroke of such air cylinders.

Figure 4:
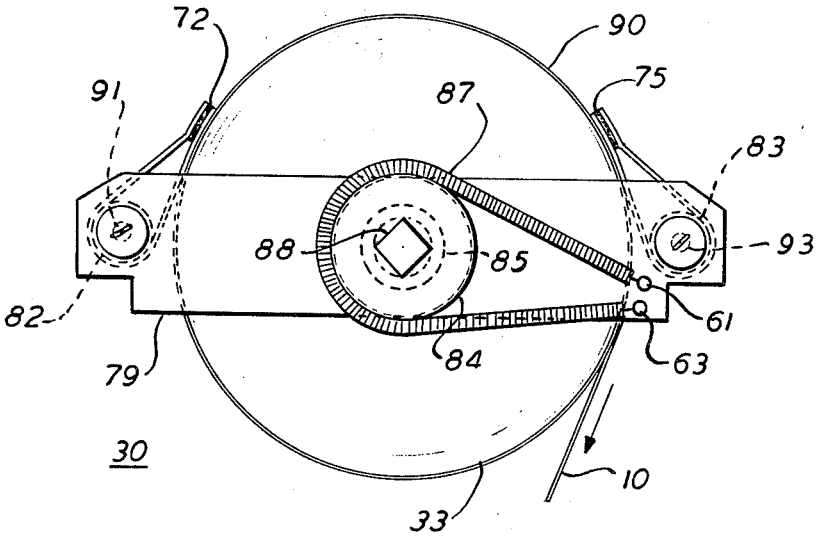
FIG. 4 is a mechanical schematic drawing showing a plan view of the reel carrier means, showing the coil spring, pulley, and elastic band.
Figure 5:
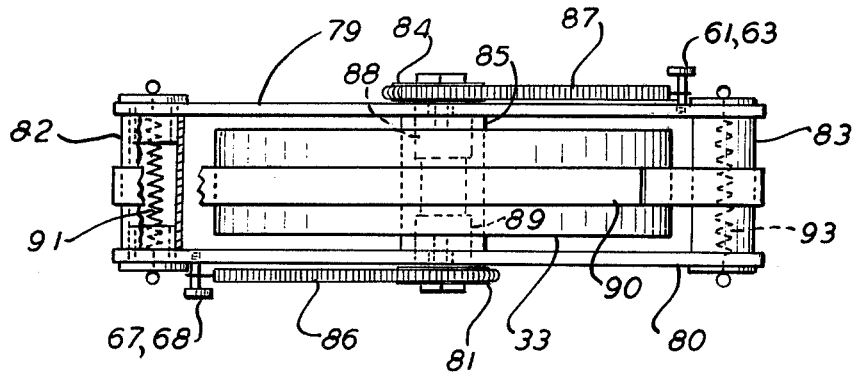
FIG. 5 is a mechanical schematic drawing which depicts a side view of the reel carrier means of FIG. 4.

FIG. 4 is a mechanical schematic drawing showing a front view of one embodiment of reel carrier means 30. FIG. 5 is a side view of the reel carrier means 30 of FIG. 4. The embodiment of FIGS. 4 and 5 includes a pair of side plates 79 and 80, held in fixed separation by a pair of spacer elements 82 and 83. Anchor springs 91 and 93 serve to hold side plates 79 and 80 securely against spacers 82 and 83. Square chucks 88 and 89 rotatably secure reel 33 of strip material between side plates 79 and 80.

Also shown in FIGS. 4 and 5 is one possible arrangement for applying a controlled drag and restoring torque to reel 33 of strip material, including a pulley 84 secured to square chuck 88 (which is in turn secured to the axial core 85 of reel 33 of strip material), together with a coil spring 87, which is secured to side plate 79 by pins 61 and 63. Coil spring 87 frictionally engages the pulley 84 and serves to apply a controlled drag and restoring torque to the pulley 84, and thereby to the reel 33 of strip material. As the strip material 10 is fed from reel 33 of strip material, the pulley 84, by virtue of the frictional engagement with coil spring 87, establishes a tension in one leg of coil spring 87. Thus, should any slack appear in strip material 10, the tension of coil spring 87 will serve to rotate pulley 84, and hence reel 33 of strip material, so as to take up any such slack. Also, during feed of strip material 10 from reel 33 of strip material, there is a continuous frictional drag torque exerted by the slippage of pulley 84 within coil spring 87. Both these effects, i.e., the frictional drag effect and the restoring torque effect, of pulley 84 and coil spring 87, serve to maintain tension of strip material 10 between the reel 33 of strip material and metering roll 32 within predetermined limits. A duplicate arrangement, illustrated in FIG. 5 and consisting of pulley 81, coil spring 86, and pins 67 and 68 may be provided on the front side of reel carrier means 30.

Also shown in FIGS. 4 and 5 is elastic band 90, which is secured to the spacers 82 and 83 and which frictionally engages the peripheral surface of the strip material on the reel 33 of strip material. As the strip material 10 is dispensed from reel 33 of strip material, elastic band 90 applies a controlled drag to the reel 33 of strip material so as to maintain, within predetermined limits, tension of the strip material 10 between the reel 33 of strip material and metering roll 32. An important aspect of the functioning of elastic band 90 is the fact that the frictional drag force, produced at peripheral surface 92 of strip material on reel 33 of strip material, is substantially constant regardless of the radius at which it operates, so that a greater drag torque is applied when the reel 33 of strip material is full, and a lesser drag torque is applied when the strip material on reel 33 of strip material has been substantially depleted. Since the drag torque applied to reel 33 of strip material decreases at substantially the same rate as does the radius of the peripheral surface of the strip material on reel 33 of strip material, as strip material 10 is depleted from reel 33 of strip material, tension of the strip material 10 between the reel 33 of strip material and the metering roll 32 may be maintained within predetermined limits.

Elastic band 90 may conveniently be secured to spacers 82 and 83 by means of Velcro™ pads 72 and 75, shown in FIG. 4. In this arrangement, the ends of elastic band 90 are passed around spacers 82 and 83, and the ends are then fastened to elastic band 90 itself by means of Velcro pads 72 and 75.

Spring-loaded cushion bar means 94, which is depicted in general terms in FIG. 2, further contributes to maintaining tension of strip material 10, between the reel 33 of strip material and metering roll 32, within predetermined limits. Further details of one embodiment of spring-loaded cushion bar means 94 are given in FIG. 6, which also shows metering roll 32, electric motor 36, together with drive pulley 43, timing belt 44, and driven pulley 45 secured to metering roll 32. Also shown in FIG. 6 is the nip roll 37.

Figure 6:
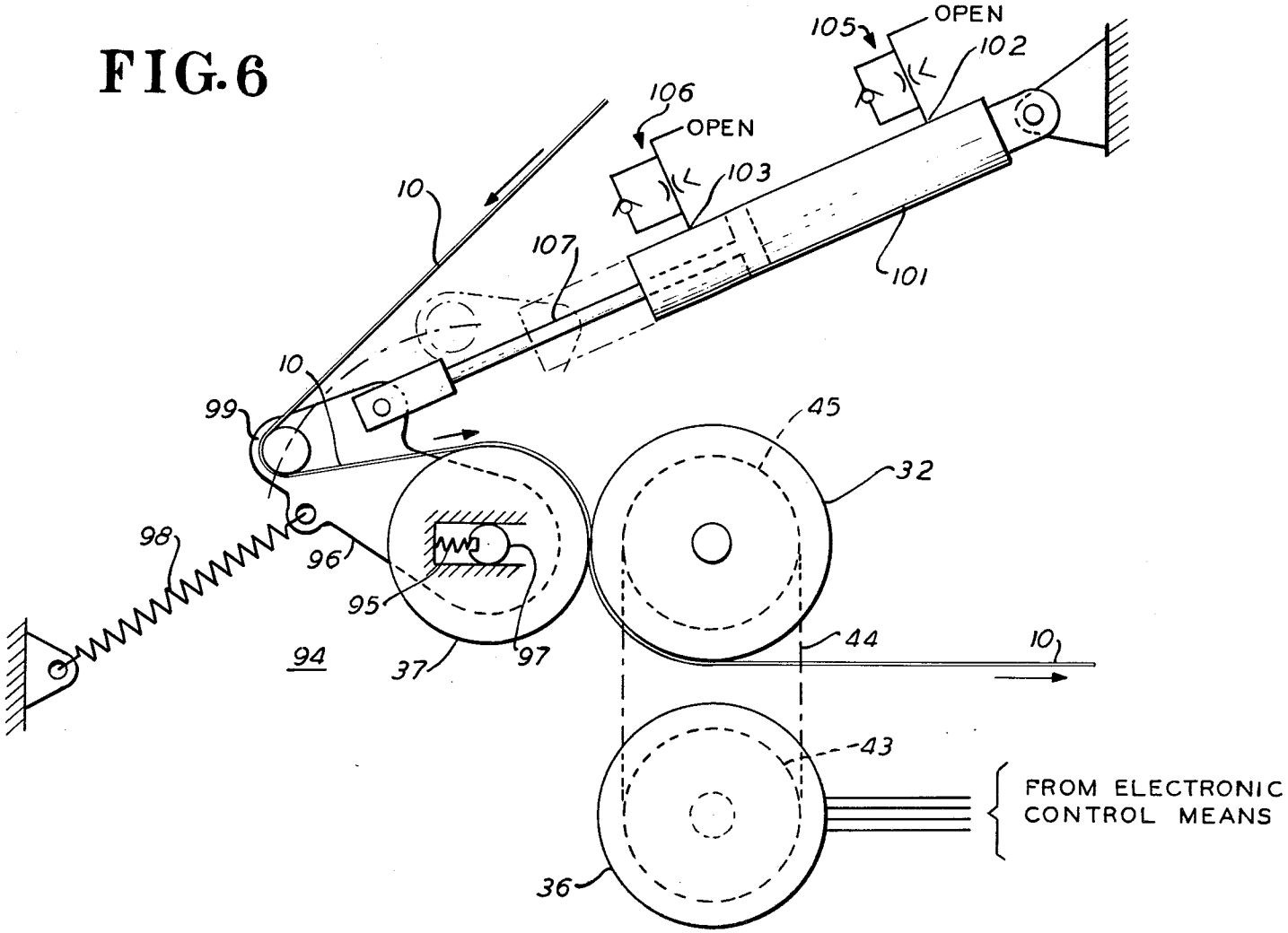
FIG. 6 is a mechanical schematic drawing showing details of the cushion bar means, together with the metering roll means and nip roll means.

The spring-loaded cushion bar means, denoted generally by reference designation 94 in FIG. 6, includes pivoting arm 96, which pivots about pressure loaded and guided axle 97. Pivoting arm 96 is spring-loaded by virtue of the operation of spring 98. Pressure loaded and guided axle 97 and spring 98 are secured to the support means, and cushion bar 99 is secured to pivoting arm 96. It can be seen, from FIGS. 2 and 6, that the spring-loaded cushion bar means 94 receives strip material 10 intermediate the reel 33 of strip material and the metering roll 32 and, by means of the force exerted by cushion bar 99 on strip material 10 because of the force applied by spring 98, serves to maintain tension of strip material 10 between the reel 33 of strip material and the metering roll 32 within predetermined limits. Pressure loaded and guided axle 97 also serves as the axle for nip roll 37. Compression spring 95 provides the requisite pressure loading of nip roll 37 against metering roll 32.

Because strip material 10 is intermittently fed from reel 33 of strip material, pivoting arm 96 does not remain stationary, but rather executes an intermittent rotational motion about pressure loaded and guided axle 97 as it operates to maintain tension of the strip material 10, between the reel 33 of strip material and the metering roll 32, within predetermined limits. It may, therefore, be desirable to provide some means for extracting energy from the motion of pivoting arm 96, and thereby dampen its excursions caused by intermittent feed of strip material 10. For example, a dashpot, secured to the support means, may be connected to pivoting arm 96 so as to dampen its excursions.

One possible embodiment of a suitable dashpot is illustrated in FIG. 6. It comprises an air cylinder 101 having a first port 102 and a second port 103. The first port 102 is vented to the atmosphere through a first flow control valve 105, while the second port is vented to the atmosphere through a second flow control valve 106. It will be understood that the term "flow control valve," as understood in the art and as diagrammed in the illustration of FIG. 6, consists of an adjustable restriction paralleled by a check valve, so that air flow in one direction is controlled by the adjustable restriction, with free flow in the opposite direction provided by the check valve.

The air cylinder is secured to the support means, and its push rod 107 is connected to pivoting arm 96. It can be seen, from FIG. 6, that as electric motor 36 is intermittently energized to cause advancement of strip material 10, pivoting arm 96 tends to rotate clockwise about pressure loaded and guided axle 97 so that cushion bar 99 moves to the right; conversely, when feed of strip material 10 by metering roll 32 is suddenly terminated, pivoting arm 96 tends to rotate counterclockwise so that cushion bar 99 moves to the left, so as to take up slack in strip material 10 which may result from overtravel of reel 33 of strip material. Flow control valves 105 and 106 serve to establish the degree of damping of the excursions of pivoting arm 96. In particular, when flow control valves 105 and 106 are adjusted so as to provide a very restricted passage for air flow out of ports 102 and 103, the damping effect of air cylinder 101 is maximized. Conversely, when flow control valves 105 and 106 are adjusted so as to provide for relatively free flow of air from ports 102 and 103 to the atmosphere, air cylinder 101 provides only a minimal damping effect on the excursions of pivoting arm 96.

Furthermore, by virtue of the separate and independent flow control valves 105 and 106 at the two ports 102 and 103 of air cylinder 101, the damping effect of air cylinder 101 can be made asymmetrical; that is, by appropriate adjustment of flow control valves 105 and 106, the damping effect for motion in a given direction may be made greater, or less, than the damping effect in the opposite direction.

Although various types of electric motors may be used as electric motor 36, a particularly suitable type is the digital stepping motor, which advances its shafts through a predetermined angular rotation in response to a given series of electrical pulses applied to its windings. By utilizing a digital stepping motor as electric motor 36, electronic control means 38 may be made to generate, and apply to the windings of electric motor 36, a suitable series of pulses so that strip material 10 is advanced from the reel 33 of strip material through utilization apparatus 31 in accordance with a predetermined program sequence.

Figure 8:
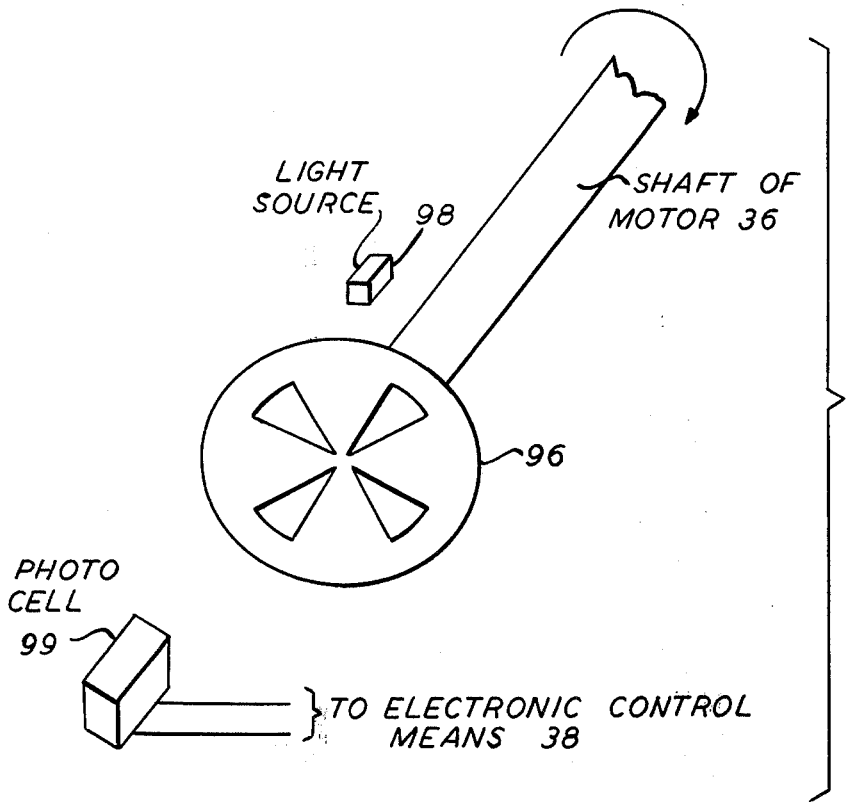
FIG. 8 is a diagrammatic illustration showing shaft encoder means.

Alternatively, and referring to FIG. 8, by supplying a shaft encoder to generate an electrical signal representative of the angular position of the shaft of electric motor 36, it is possible to use a different type of electric motor such as, for example, a dc motor. In this arrangement the shaft encoder means is electrically connected to the electronic control means 38, and supplies it an electrical signal representative of the angular position of the shaft of the electric motor 36; this electrical signal serves as a feedback signal, thus permitting electronic control means 38 to suitably energize the windings of electric motor 36 so as to advance strip material 10 from the reel 33 of strip material through utilization apparatus 31 in accordance with the predetermined program sequence further, and as will be understood by those skilled in the art, the shaft encoder may be embodied specifically in various apparatus, such as for example, the well-known dc closed loop servomotor drive, and as illustrated in FIG. 8, the shaft encoder may include a rotatable, light chopper disc 96, a light source 98 and a photocell 99 whereby the angular position of the shaft of the motor 36 may be determined by the light passing from the light source 98 to the photocell 99 being chopped or interrupted by the disc 96 to generate the electric signal indicative of the angular position of the shaft of the motor 36 which signal is transmitted to the electronic control means 38. Additionally, and as further known to those skilled in the art, the shaft encoder means may include tachometer means for generating a tachometer signal used to coarsely align the speed of the dc motor with the predetermined program sequence of acceleration, deceleration, start and stop.

Figure 7:
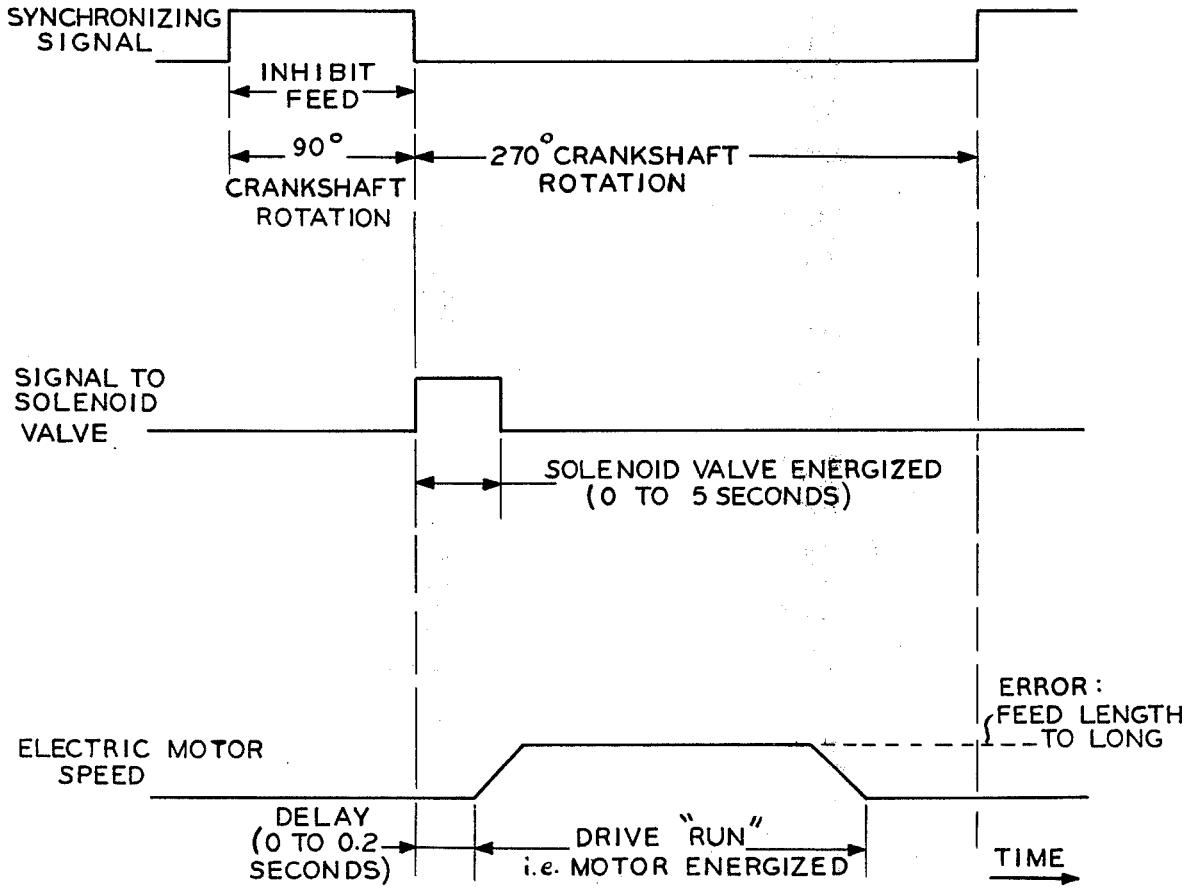
FIG. 7 is a timing diagram showing the sequence of operation of the various components of the machine, during a portion of the predetermined program sequence, as programmed by the electronic control means.

FIG. 7 is a timing diagram showing a portion of a typical predetermined program sequence of advancing strip material 10 through utilization apparatus 31. The upper trace of FIG. 7 is representative of the timing or Synchronizing Signal supplied electronic control means 38, via electrical conductor 48, from utilization apparatus 31. The Synchronizing Signal may be developed, for example, by optically or electromagnetically sensing the position of the crankshaft of utilization apparatus 31. During the initial portions of the cycle depicted in FIG. 7, this synchronizing signal is "high," signifying that an impression is in process and the strip material 10 must remain stationary. This portion of the synchronizing signal serves to cause electronic control means 38 to inhibit feed of strip material 10 during this time, corresponding to approximately 90° of rotation of the crankshaft of utilization apparatus 31. Advancement of strip material 10, under the control of electronic control means 38, takes place during the remaining 270° of rotation of the crankshaft of utilization apparatus 31, as can be seen from FIG. 7.

The center trace of FIG. 7 shows the electrical signal applied by electronic control means 38, via electrical conductors 65, to solenoid valve 64. It can be seen from FIG. 7 that the solenoid valve 64 is energized for an adjustable period of time following the "inhibit feed" interval. This signal causes actuation of stripper means 50 so as to cause release of the strip material 10 within utilization apparatus 31 immediately following the impression operation by utilization apparatus 31. In some instances on air blast, along the strip material 10 within utilization apparatus 31, may also be used to assist in releasing strip material 10. Although this technique is known to the prior art, it should be pointed out that a source of air for such an air blast, suitably timed, is available at the output port of solenoid valve 62. In this way, the air blast (if used) and the operation of stripper means 50 are synchronized with each other and with the operation of utilization means 31.

The lower trace of FIG. 7 is representative of the shaft speed of electronic motor 36, as controlled by electronic control means 38. After an adjustable delay following the "inhibit feed" segment of the Synchronizing Signal, the motor 36 is caused to run through a predetermined angular rotation, resulting in a predetermined advance of strip material 10 from reel 33 of strip material through utilization apparatus 31.

Electronic control means 38 may conveniently provide predetermined limits of maximum angular acceleration and deceleration of the shaft of electric motor 36, as illustrated by the sloping segments of the lower trace of FIG. 7. By establishing such maxima of acceleration and deceleration, which thereby establishes corresponding maxima of acceleration and deceleration of the strip material 10 and the angular rotation of reel 33 of strip material, the rate at which strip material can be advanced, without problems of overtravel and tangling of strip material 10, may be maximized.

In a similar fashion, electronic control means 38 may also conveniently include an adjustable predetermined limit on the angular velocity of the shaft of electric motor 36. Such a limitation may also be advantageously utilized to secure a maximum rate of advancement of strip material 10 through utilization apparatus 31 without overtravel and tangling of strip material 10.

Electronic control means 38 may also include provision for sensing, and indicating, an error condition such as that caused by an operator adjusting the unit for a greater length of advancement than can be accomplished during the available 270° of rotation of the crankshaft of utilization apparatus 31. In this situation, electronic control means 38 can be made to sense that the required advancement of strip material 10 has not yet been achieved by the time the Synchronizing Signal, the upper trace of FIG. 7, again goes high. Sensing this situation, electronic control means 38 may then immediately bring electric motor 36 to a stop, so that strip material 10 within utilization apparatus 31 is stationary during the impression cycle. A front-panel indicator light may also be provided on electronic control means 38 to call the error condition to the attention of the operator.

It will be understood by those skilled in the art that many modifications and variations of the present invention may be made without departing from the spirit and the scope thereof.

What is claimed is:

1. A machine for advancing strip material from a reel of the strip material through a utilization apparatus, the machine comprising:

a. support means for securing component parts of the machine in a predetermined spatial relationship;

b. reel carrier means, secured to said support means, said reel carrier means for carrying said reel of strip material and for applying a controlled drag and restoring torque to said reel of strip material;

c. metering roll means, rotatably secured to said support means so as to receive said strip material intermediate said reel of strip material and said utilization apparatus, said metering roll means for advancing said strip material;

d. spent strip material receiving means, secured to said support means so as to receive said spent strip material exiting said utilization apparatus, said spent strip material receiving means for receiving said spent strip material and for maintaining, within predetermined limits, tension of said spent strip material exiting said utilization apparatus;

e. electric motor means, secured to said support means and having a shaft which is mechanically coupled to said metering roll means, said electric motor means for causing rotation of said metering roll means; and f. electronic control means, electrically connected to said motor means, said electronic control means for electrically energizing said motor means to cause rotation of said motor shaft through a predetermined program sequence;

whereby strip material is advanced from said reel of strip material through said utilization apparatus in response to energization of said electric motor means, by said electronic control means, in accordance with said predetermined program sequence.

2. A machine as recited in claim 1, in which said reel carrier means comprises a pair of substantially rectangular plates held in fixed separation by a pair of spacer elements.

3. A machine as recited in claim 1, wherein said reel of strip material has an axial core and in which said reel carrier comprises:

a. a pulley, secured to said axial core of said reel of strip material; and b. coil spring means, secured to said support means and frictionally engaging the pulley, said coil spring means for applying a controlled drag and restoring torque to said pulley and thereby to said reel of strip material;

whereby tension of said strip material between said reel of strip material and said metering roll is maintained within predetermined limits.

4. A machine as recited in Claim 1, in which said reel carrier comprises:

elastic band means, secured to said support means and frictionally engaging a peripheral surface of said strip material on said reel of strip material, said elastic band means for applying a controlled drag to said reel of strip material;

whereby tension of said strip material between said reel of strip material and said metering roll is maintained within predetermined limits.

5. A machine as recited in Claim 1, further comprising:

spring-loaded cushion bar means, secured to said support means so as to receive said strip material intermediate said reel of strip material and said metering roll means, said spring-loaded cushion bar means for maintaining, within predetermined limits, tension of said strip material between said reel of strip material and said metering roll means.

6. A machine as recited in claim 5, in which said spring-loaded cushion bar means comprises a dashpot.

7. A machine as recited in claim 6, in which said dashpot comprises an air cylinder.

8. A machine as recited in claim 7, wherein said air cylinder has at least one air port, further comprising an adjustable air restriction connected to said air port of said air cylinder.

9. A machine as recited in Claim 1, further comprising:

nip roll means, rotatably secured to said support means so as to be in frictional engagement with said metering roll means, said strip material passing between and in frictional contact with both said metering roll means and said nip roll means, said nip roll means for establishing positive frictional engagement between said metering roll means and said strip material.

10. A machine as recited in Claim 1, further comprising:

stripper means, secured to said support means so as to receive said strip material intermediate said metering roll means and said utilization apparatus, said stripper means for applying a predetermined impulse of tension to said strip material within said utilization apparatus thereby to release said strip material within said utilization apparatus.

11. A machine as recited in Claim 10, in which said stripper means comprises:

a. a first fixed bar, secured to said support means;

b. a movable bar, translatably secured to said support means so as to permit translational motion perpendicular to the axis of the movable bar;

c. a second fixed bar, secured to said support means;

d. said strip material looping around said first fixed bar, around said movable bar, and around said second fixed bar such that the length of strip material looping around said first fixed bar, around said movable bar, and around said second fixed bar is altered by translation of said movable bar;

e. means, secured to said support means, for translating said movable bar in a direction perpendicular to said axis of said movable bar;

whereby translation of said movable bar applies a predetermined impulse of tension to said strip material within said utilization apparatus thereby to release said strip material within said utilization apparatus.

12. A machine as recited in Claim 11, in which said means for translating said movable bar comprises:

a. an air cylinder, having an air inlet port, said air cylinder secured to said support means;

b. said air inlet port connected through a solenoid valve to a source of pressurized air;

c. said solenoid valve electrically connected to said electronic control means;

whereby said electronic control means energizes said solenoid valve at an appropriate time during said predetermined program sequence so as to actuate said air cylinder to cause translation of said movable bar and application of a predetermined impulse of tension to said strip material within said utilization apparatus thereby to release said strip material within said utilization apparatus.

13. A machine as recited in Claim 12, in which said movable bar is translatably secured to said support means by:

rack and pinion means, said rack and pinion means for maintaining said axis of said movable bar parallel, during translation, to said axes of said first fixed bar and said second fixed bar.

14. A machine as recited in claim 1, in which said electric motor means comprises a digital stepping motor.

15. A machine as recited in Claim 1, further comprising:

a. shaft encoder means, secured to said support means, said shaft encoder means for generating an electrical signal representative of the angular position of the shaft of said electric motor means;

b. said shaft encoder means electrically connected to said electronic control means;

whereby said electronic control means is supplied information as to the instantaneous angular position of said shaft of said electric motor means.

16. A machine as recited in claim 15, in which said electric motor means comprises a dc motor.

17. A machine as recited in claim 1, in which said shaft of said electric motor means is mechanically coupled to said metering roll means by a timing belt and pulleys.

18. A machine as recited in claim 1, in which said predetermined program sequence, through which said electronic control means causes rotation of said shaft of said electric motor means, includes predetermined limits of maximum angular acceleration and deceleration.

19. A machine as recited in claim 1, in which said predetermined program sequence, through which said electronic control means causes rotation of said shaft of said electric motor means, includes a predetermined limit of maximum angular velocity.

* * * * *